United States Patent [19]

Whitney

[11] 4,195,969

[45] Apr. 1, 1980

[54] VACUUM CLEANER

[75] Inventor: Robert P. Whitney, Grand Haven, Mich.

[73] Assignee: Clarke-Gravely Corporation, Muskegon, Mich.

[21] Appl. No.: 867,348

[22] Filed: Jan. 5, 1978

[51] Int. Cl.[2] ..... F04B 39/00; F04D 25/16; F04D 29/66

[52] U.S. Cl. ..... 417/247; 15/412; 417/423 A; 417/312

[58] Field of Search ..... 417/312, 313, 423 A, 417/247; 181/256, 252, 249, 272, 264; 15/412, 326

[56] References Cited

U.S. PATENT DOCUMENTS

| | | | |
|---|---|---|---|
| 1,418,238 | 5/1922 | Cramer | 15/326 X |
| 2,125,850 | 8/1938 | Norris | 181/256 X |
| 2,281,858 | 5/1942 | Pierce | 15/326 X |
| 2,719,596 | 10/1955 | Kent et al. | 417/423 A |
| 2,731,194 | 1/1956 | Kent | 417/312 |
| 3,101,889 | 8/1963 | Tatge | 417/423 A |
| 3,220,638 | 11/1965 | Petersen | 417/423 A |
| 3,906,584 | 9/1975 | Hult | 417/423 A |

*Primary Examiner*—Carlton R. Croyle
*Assistant Examiner*—Edward Look
*Attorney, Agent, or Firm*—Price, Heneveld, Huizenga & Cooper

[57] ABSTRACT

A vacuum cleaning apparatus is disclosed having a suction head adapted for use on a collection tank. The suction head includes a base, at least one blower-motor unit mounted on the base and having a suction intake and an exhaust outlet. The exhaust outlet of the unit is connected to a baffled sound chamber within which a plurality of sound absorbing elements are positioned. Another blower-motor unit may be mounted on the base with the units interconnected in series. A cover carried by the base encloses the blower-motor unit or units and also defines a baffled cooling air intake passage for each blower-motor unit. The suction inlet is connected to an intake aperture through a transfer chamber.

29 Claims, 10 Drawing Figures

VACUUM CLEANER

BACKGROUND OF THE INVENTION

The present invention relates to vacuum cleaning apparatus of the wet/dry type and more particularly, to a unique suction head adapted for use with a plurality of different size debris collection tanks.

Heretofore, various forms of wet/dry vacuum cleaning apparatus have been proposed. Generally, each of these prior proposals includes a suction head having a blower-motor unit or suction unit. Typically, the suction head is removably mounted on the top of an open end, debris collection tank. Apparatus of the aforementioned type are capable of collecting either dry material or liquid from the surface to be cleaned. An example of one such apparatus may be found in U.S. Pat. No. 2,731,103 to Ortega, entitled VACUUM CLEANING DEVICE, and issued on Jan. 17, 1956.

Conventional wet/dry vacuum apparatus have suffered from various problems primarily related to noise of operation, insufficient suction or lift for certain applications, bulkiness and various manufacturing problems related to ease of assembly and relative costs. Attempts have been made to alleviate some of these problems. For example, the vacuum cleaner disclosed in U.S. Pat. No. 2,719,596, entitled VACUUM CLEANER, and issued to M. A. Kent et al on Oct. 4, 1955 includes provision for muffling the exhaust noise from a blower-motor unit contained within a suction head. As shown in that patent, one or more parallel operated blower-motor units are mounted on a base. Secured to the base is a cover having an opening at the top thereof through which the air is exhausted. A muffler structure is secured to the top of the cover to reduce the noise of the exhaust. A plurality of sound absorbing elements are disposed within the muffler structure to define a progressively restricted passageway. Also, sound absorbing material lines the inner surface of the cover.

Various proposals have been made for increasing the lift or suction capabilities of conventional wet/dry vacuum cleaning apparatus. Examples of such prior proposals may be found in U.S. Pat. No. 2,666,498, entitled SUCTION CLEANER, issued on Jan. 19, 1954 to W. L. Peterson and U.S. Pat. No. 3,848,290, entitled RINSE METHOD AND MACHINE, and issued on Nov. 19, 1974 to C. R. Bates. The suction cleaner disclosed in the aforementioned Peterson patent includes a single electric motor having a shaft upon which a pair of rotary fan blade assemblies are mounted. The rotors of the assemblies comprise a two-stage suction fan. Air leaving the second stage rotor is discharged from the machine through a thin, narrow, annular discharge passage provided between the top of a member which supports the blower-motor unit and the lower edge of a ring member which forms a part of a cover or enclosure. The structure disclosed in the Bates patent includes a pair of separately powered blower units connected in series. The blower units are connected and mounted one above the other in vertical, superimposed relationship.

The prior art proposals while attempting to eliminate or deal with one of the aforementioned problems have tended to aggravate several of the remaining problem areas. For example, in an attempt to reduce the noise emissions from a vacuum cleaner, the resulting structure may become excessively bulky and aesthetically nonpleasing. In an attempt to increase the suction or lift capacity by providing a pair of blower-motor units connected in series and mounted in a vertical, superimposed relationship, the overall vertical dimensions of the second suction head must necessarily be increased. As a result, prior proposals have not been totally satisfactory. Also, the suction heads have been primarily adapted to fit one particular debris collection tank. As a result, versatility has been limited.

SUMMARY OF THE INVENTION

Essentially, the vacuum cleaning apparatus of the present invention includes a suction head adapted for mounting on a plurality of different size tanks and which includes a base and a cover supported on the base. One or more blower-motor units are secured to the base. Provision is made for muffling exhaust from the blower-motor unit or units which includes the use of a sound chamber defined in part by the base and enclosed by the cover.

In narrower aspects of the invention, the base of the suction head includes an intake aperture, a transfer inlet aperture and a transfer outlet aperture. A blower-motor unit is mounted on the base and includes a suction intake positioned above the transfer outlet aperture. Provision is made for interconnecting the transfer inlet aperture with the transfer outlet aperture and for interconnecting the intake aperture of the base with the transfer inlet aperture. The interconnection between the intake aperture and the transfer inlet aperture is accomplished either by a connecting tube or another blower-motor unit. The two units are connected in series and positioned in side-by-side relationship on the common base. Also, provision is made for providing cooling air for the blower-motor unit by a passage defined in part by a cover structure.

The unique suction head in accordance with the present invention permits a standard size base to be employed with a wide variety of collection tanks and also permits a standard base to be manufactured for either single blower-motor unit applications or dual blower-motor unit applications. The present invention efficiently muffles the exhaust noise from the blower-motor unit or units without adversely affecting the aesthetics of the apparatus, permits dual motor operation without increasing the overall bulkiness or size of the suction head and results in increased ease of assembly and reduced manufacturing costs when compared to prior art devices.

DETAILED DESCRIPTION OF THE PREFERRED EMBODIMENTS

Figure 1:
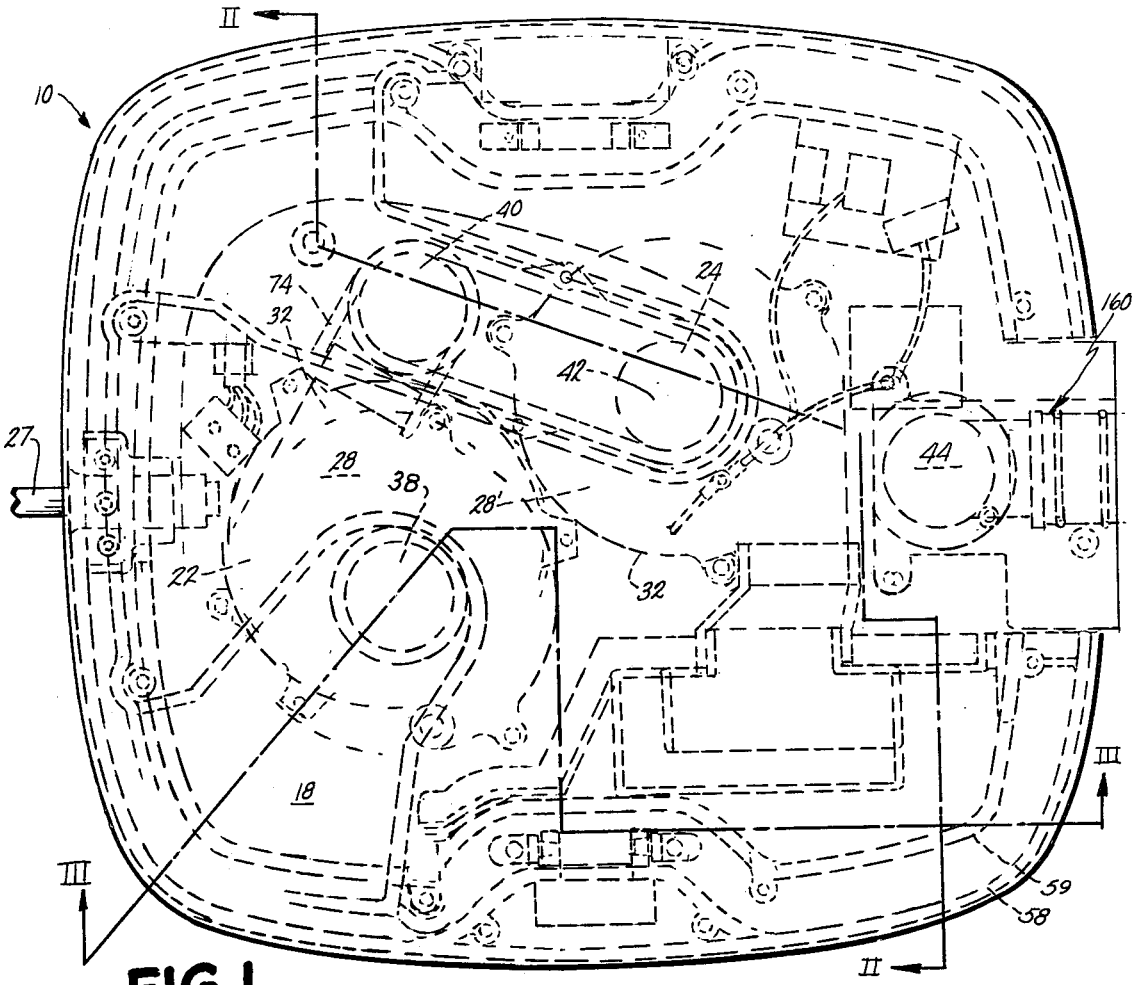
FIG. 1 is a top, plan view of a dual blower-motor suction head in accordance with the present invention.
Figure 2:
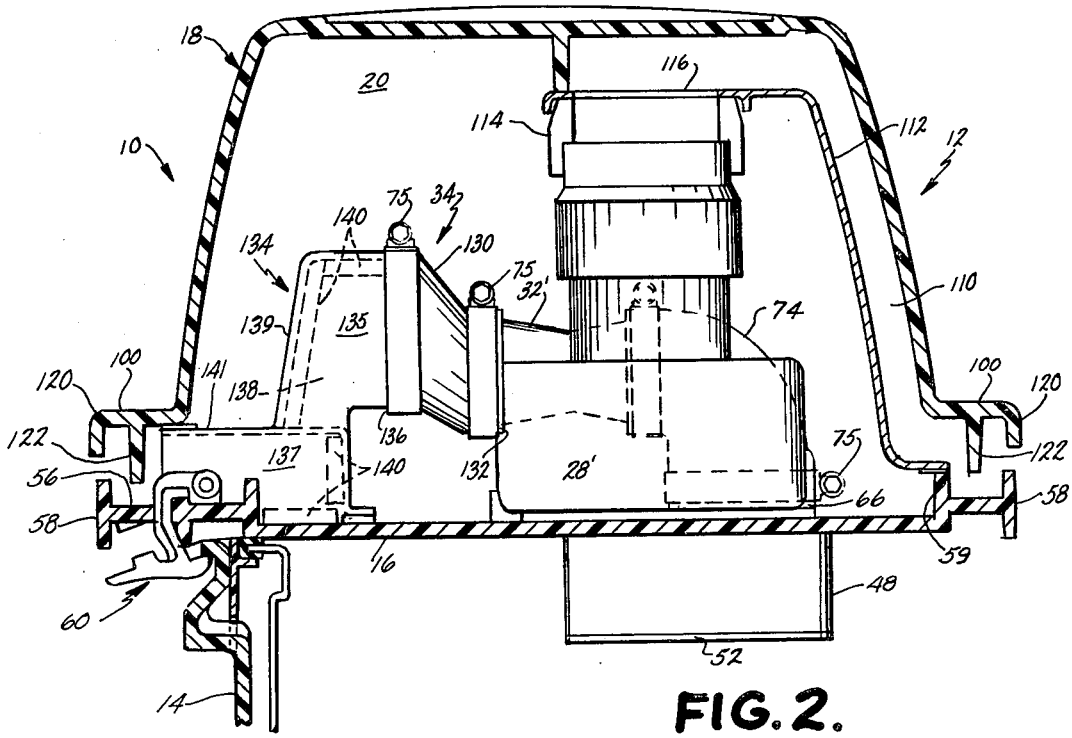
FIG. 2 is a partial, cross-sectional view taken generally along line II—II of FIG. 1 with one of the blower-motor units removed.
Figure 3:
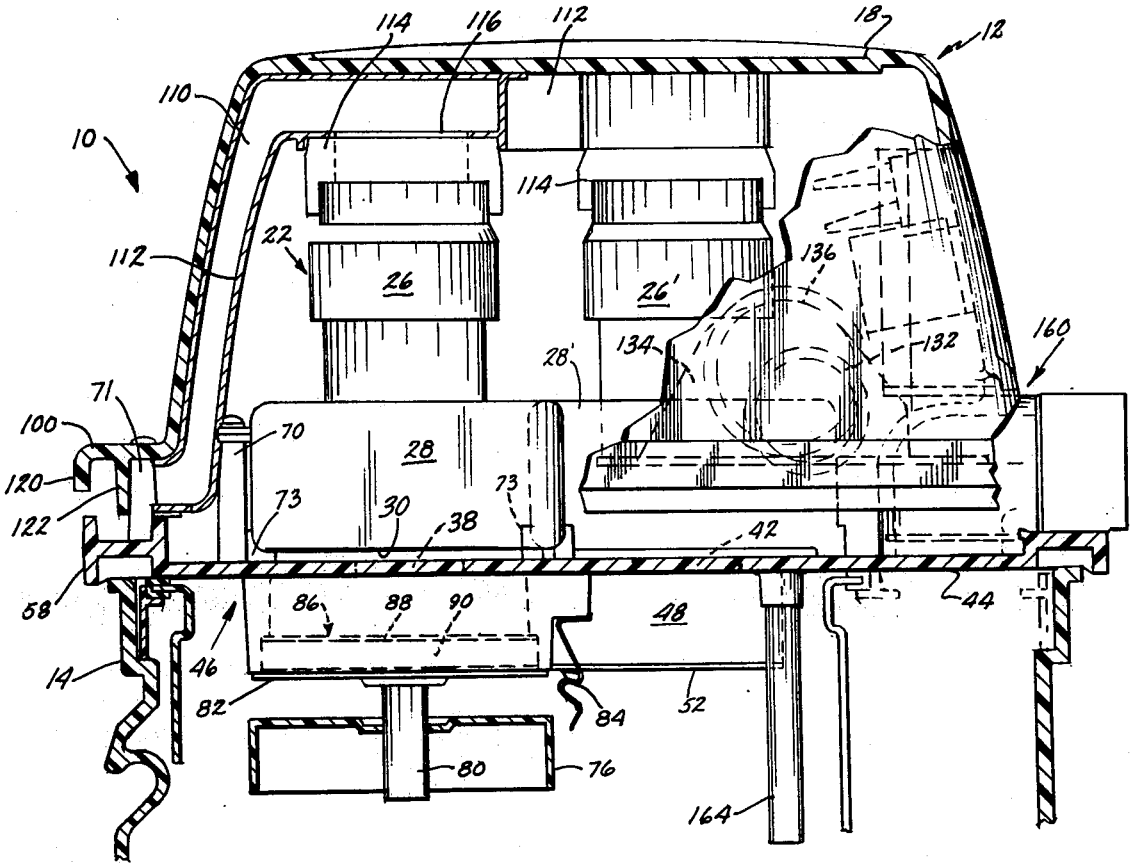
FIG. 3 is a fragmentary, cross-sectional, elevational view taken generally along line III—III of FIG. 1.

A preferred embodiment of the unique vacuum cleaning apparatus in accordance with the present invention is illustrated in the drawings and generally designated 10. As seen in FIGS. 1, 2 and 3, the vacuum cleaning apparatus includes a suction head 12 mountable on the top of an open ended debris collection tank 14. The suction head 12 includes a molded, one-piece, plastic base 16 and a cover 18. The cover 18 is mounted on the base 16 and defines therewith a blower-motor unit or suction unit enclosure 20. As seen in FIGS. 1 and 3, a pair of blower-motor units 22, 24 may be secured on the base plate 16. The blower-motor units 22, 24 are preferably identical and include electric motors 26, 26' and fan units 28, 28', respectively. Electrical power is supplied to the motors 26 by a suitable power cable 27 (FIG. 1). Each unit includes a centrally located suction intake 30 and a peripheral exhaust outlet 32, 32', respectively (FIGS. 1 and 2). In FIG. 2, motor-fan or blower-motor unit 22 has been deleted for clarity. The exhaust outlet 32 is shown in hidden lines in FIG. 2.

Figure 4:
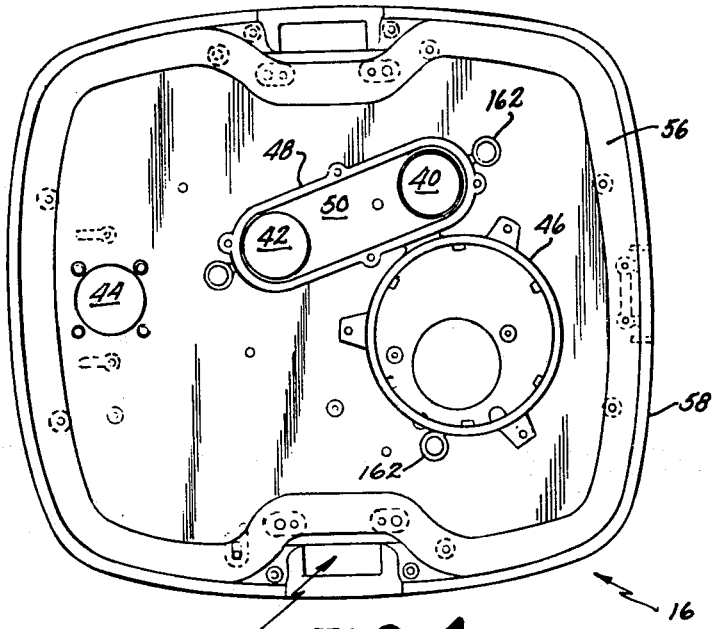
FIG. 4 is a bottom, plan view of the base included in the present invention.
Figure 5:
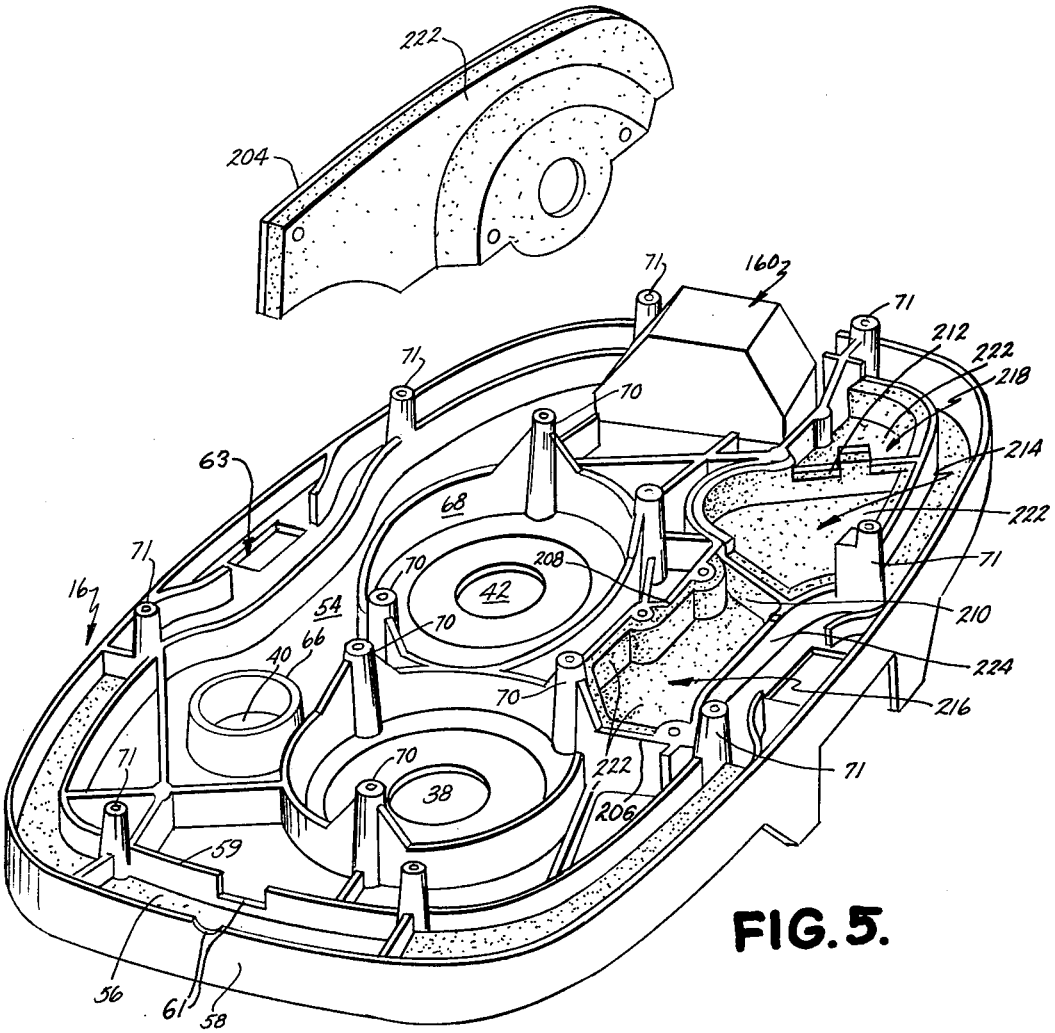
FIG. 5 is a perspective, exploded, top view of the base showing the sound baffle and sound chamber of the present invention.

The base structure 16 is best seen in FIGS. 2, 4 and 5. In the preferred construction, the base 16 is a molded, plastic member formed with and defining therethrough an intake aperture 38, a transfer inlet aperture 40, a transfer outlet aperture 42 and a hose coupling inlet aperture 44. The undersurface of the base, as seen in FIGS. 3 and 4, is formed with an integral, float valve housing 46 and an air transfer housing 48 defining an air transfer chamber 50 interconnecting inlet and outlet 40, 42. It is presently preferred that the housing 48 be molded integral with the undersurface of the base 16. A closure plate or cover element 52, as seen in FIG. 2, is secured thereto to define the chamber 50. A gasket is preferably placed between the plate 52 and the walls of housing 48 to prevent air leakage. In the alternative, the housing 48 could be fabricated as a separate, open topped piece and subsequently attached to the undersurface of the base.

The suction head includes a hose coupling assembly 160 (FIGS. 1 and 3) communicating with aperture 44. A suitable length of hose (not shown) is connected to the coupling 160. When the cleaning apparatus is operated, wet or dry debris will be delivered to the collection tank 14 through the coupling 160.

As seen in FIGS. 2 and 5, the base 16 is stepped in configuration and includes a central, flat portion 54 and a raised, horizontal peripheral flange 56. Extending around the periphery of the base flange 56 are vertically upstanding skirts 58 and 59. Skirt 58 is integral with the extreme outer periphery and skirt 59 extends vertically from the upper surface of flange portion 56. Suitable cutouts 61 are formed in skirts 58, 59 for entrance of power cord 27. The vertical offset between the flange portion 56 and the central portion 54 and the vertically extending skirt 58 defines an area at which the base may be clamped to the collection tank 14 by suitable clamps 60, as shown in FIGS. 2 and 3. Clamps 60 are secured at apertured and recessed areas 63 formed on each side of the base 16. Also, the skirts 58, 59 cooperate with the cover 12, as more fully explained below, to define a baffled exhaust or restricted passage outlet and a baffled, motor cooling air inlet.

An upstanding nipple or coupling 66 is formed around the transfer inlet 40 (FIGS. 2 and 5). The upper surface of the central portion 54 of the base plate is provided with integrally molded blower locating flanges 68 and mounting bosses or posts 70 (FIG. 5). As seen in FIG. 3, the blower-motor units 22, 24 are secured to the base 16 at bosses 70. The fan units are located and partially housed on the base 16 by flanges 68. Gaskets 73 (FIG. 3) seal the units against the base. Gaskets 73 "rubber mount" the units 22, 24 and assist in reducing the noise of operation. A plurality of upstanding, integral bosses 71 are also provided around the periphery of the base as shown in FIG. 5. The cover 18 is secured to bosses 71 and thereby maintained in proper spaced relationship with the base 16. This is also seen in FIG. 3. The ribbed nature of the upper surface of the base reinforces the base structure and permits a sufficiently strong base to be fabricated from a reduced amount of material.

Figure 7:
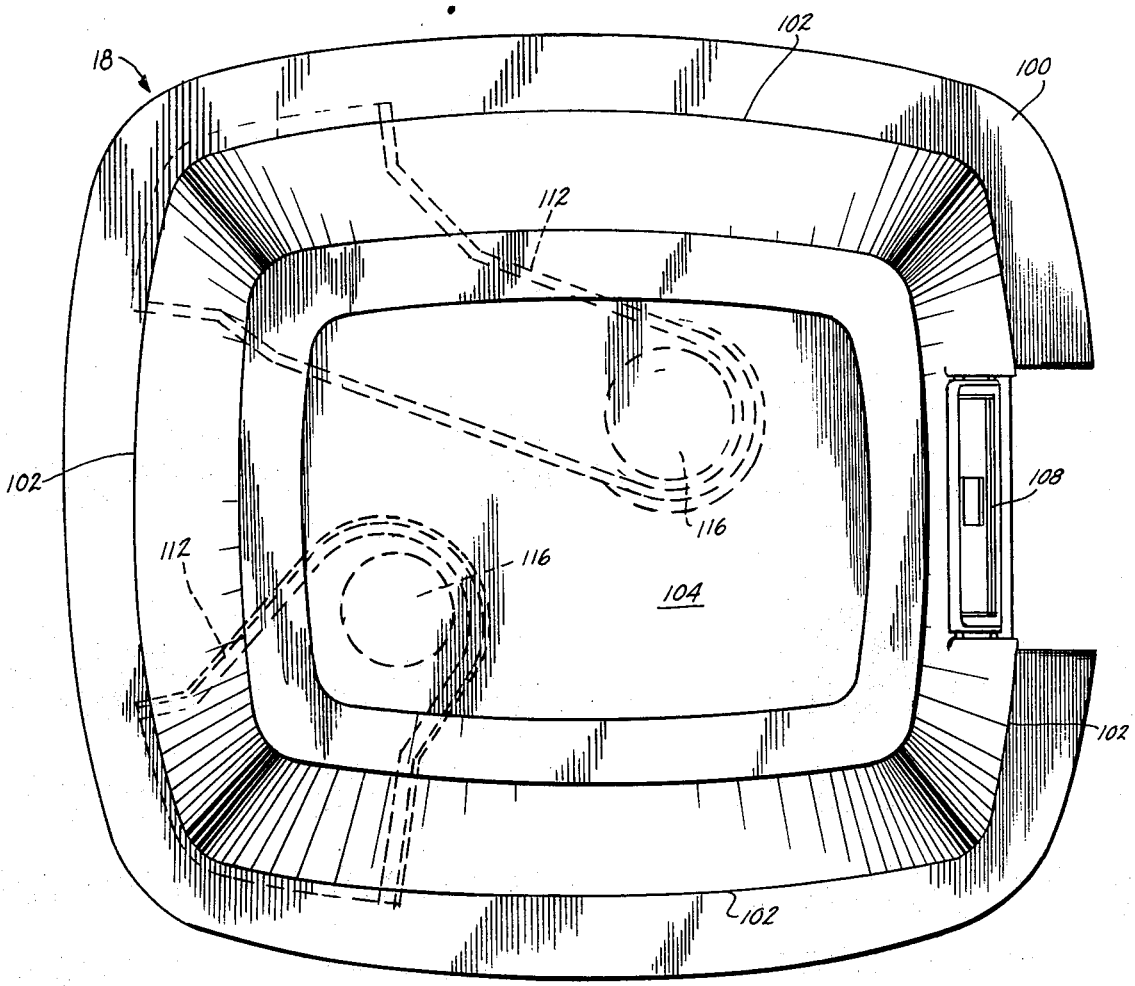
FIG. 7 is a top plan view of the cover of the suction head.
Figure 8:
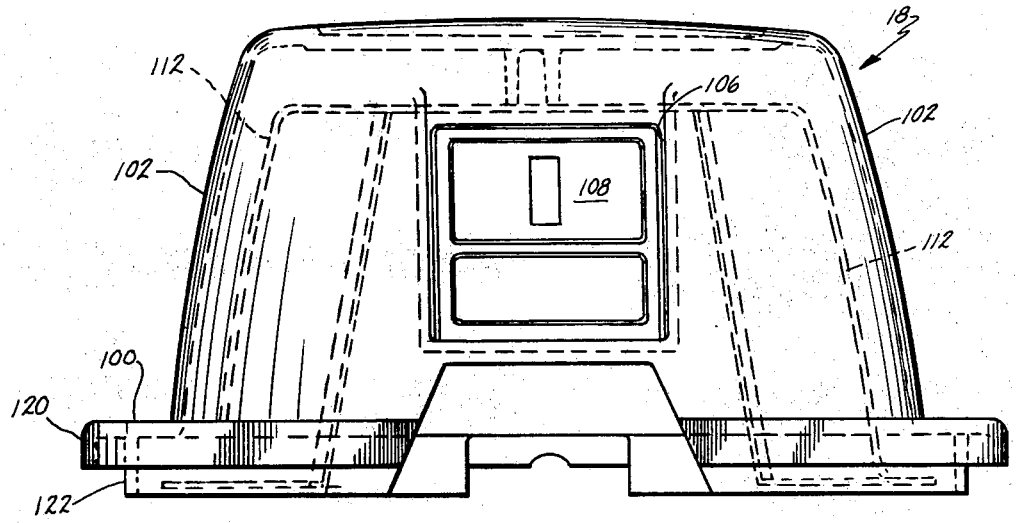
FIG. 8 is a side elevational view of the cover.

The cover 18 is illustrated in FIGS. 7 and 8. As shown therein, cover 18 includes a peripheral, horizontal flange 100, sidewalls 102 and a top surface 104. One of the sidewalls 102 is provided with a cutout portion 106 within which a control panel 108 may be mounted. As seen in FIGS. 2 and 3, cooling air is directed to the top of the motors 26 and 26' of the blower-motor units by cooling air intake passages 110 defined in part by the inner surface of the cover sidewalls 102 and top 104. A generally S-shaped plate member 112 having a channel shape in section is attached to the inner surface of the cover to define the cooling air inlet passages 110. Cooling air is directed from the periphery of the suction head upwardly through the passage 110 and exhausted at the motor units. A suitable foam gasket 114 is positioned between the top of the motor 26 and an outlet opening 116 of the cooling air passage 110.

The cover includes a pair of downwardly extending skirts or outer and inner baffles 120, 122 which extend around the periphery of the horizontal flange portion 100 in spaced, parallel relationship. As seen in FIGS. 2 and 3, the skirts 120, 122 in combination with the usptanding skirts or flanges 58 and 59 of the base 16 define a baffled or restricted inlet to the cooling air passages. This inlet reduces the intake noise associated with the drawing in of cooling air to the blower motors 26. Also, intake noise is reduced by restricting the cooling air to the passages 110 defined by the cover 18 and the plate members 112.

In the embodiment illustrated in FIGS. 1, 2, and 3, a pair of blower-motor vacuum units 22, 24 are mounted on the common base 16 in a side-by-side tandem arrangement.

Blower-motor unit 22 is mounted over the intake aperture 38 of the base 16. Blower-motor unit 24 is mounted over the transfer outlet aperture 42. The exhaust outlet from blower-motor unit 22 is connected to the transfer inlet aperture 40 by a suitable tubular coupling 74. The ends of coupling 74 are secured to the blower-motor exhaust outlet and to the nipple 66 by suitable hose clamps 75. As seen in FIG. 3, an inverted, cup float valve 76 is slidably mounted on a rod 80 extending downwardly from a float mounting plate 82 below intake aperture 38. The float mounting plate 82 supports a filter assembly 86. The filter assembly includes a wire mesh screen 88 and a foam filter 90. The inverted float valve 76 and the filter assembly including elements 88 and 90 prevent the ingestion of foam or liquid material into the blower-motor units 22 or 24 when the cleaner is employed for wet pick-up.

The blower-motor units 22, 24 are connected in series so that the lift or suction provided by the head 10 is increased over that provided by a single motor. Air is drawn up from the collection tank 14 through the filter unit 86 and the intake aperture 38 to the first blower-motor unit 22. The air is exhausted from this blower-motor unit 22 through its exhaust outlet 32 and passes via coupling 74 through the air transfer chamber 50 to the intake of the second blower-motor unit 24 positioned immediately above and in superimposed relationship with the transfer passage outlet 42. The exhaust outlet 32' of blower-motor unit 24 exhausts the air through a unique muffler assembly 34.

Figure 6:
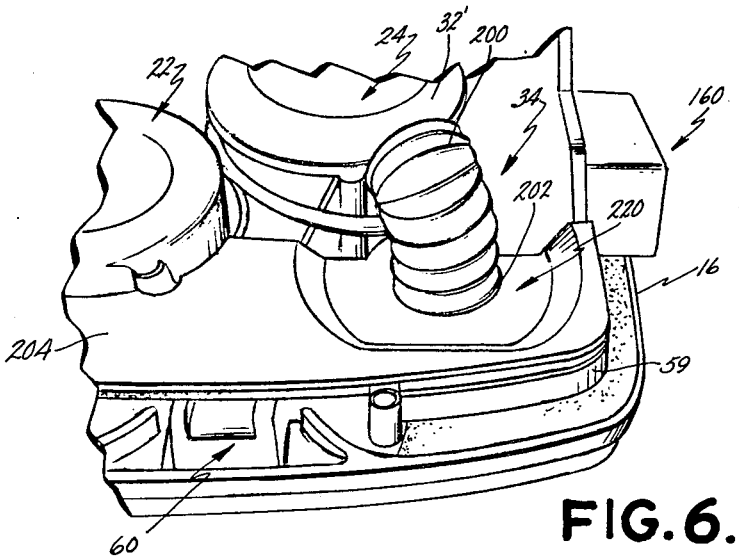
FIG. 6 is a fragmentary, perspective view of the suction head.

The presently preferred embodiment of the muffler assembly is illustrated in FIGS. 5 and 6. An alternative embodiment is illustrated in FIGS. 1, 2 and 3. In the preferred embodiment, a tubular coupling 200 extends from exhaust outlet 32' to a nipple 202 defining an inlet aperture on the upper surface of a sound chamber baffle 204. Sound chamber baffle 204 is attached to the base 16 at flange 59 and at sound chamber defining walls 206, 208, 210 and 212. Flange 59 and walls 206, 208, 210 and 212 divide the sound chamber into three subchambers 214, 216 and 218. The subchambers are interconnected by cutouts in intermediate walls 210 and 212. Baffle plate 204 is generally flat and recessed or cupped at an area 220 over chambers 214 and 218. The inlet coupling or nipple 202 is formed in the recessed area. The undersurface of the plate 204, the walls and floors of the chambers 214, 216 and 218 are covered with foam type sound absorbing elements 222. The area of the flange 59 adjacent the recesses for the clamps 60 is notched to define an atmospheric exhaust outlet 224. The baffle plate 204 is attached to the base and extends around flange 59 and walls 206, 208. Blower air will leak out around the periphery of the baffle plate but will be primarily exhausted through the notched portion 224 of flange 59. The exhaust noise normally associated with the blower-motor operation is substantially reduced and muffled since the exhaust air first passes through an angle of 90° in coupling 200 then enters sound chamber 214. Upon entering sound chamber 214, the air contacts the foam sound absorbing elements and is again passed through an angle of 90° towards chambers 216 and 218. In passing into these chambers, the air must pass through the restricted cutouts in walls 210 and 212. This further reduces the exhaust noise levels. The majority of the exhaust air then exits from chamber 216 through baffled outlet 224.

The exhaust air when exiting through outlet 224 and around the periphery of flange 59 then passes through a baffled area defined by flange 58 and skirts 120, 122 of the cover 18. The air therefore passes to atmosphere in a serpentine fashion and is caused to change direction multiple times. The exhaust or muffler system 34 in conjunction with the sound deadening or absorbing elements substantially reduces the exhaust noise normally associated with operation of the blower-motor units. The system is contained within the cover 18, is compact and permits the suction head to be uncluttered in appearance.

An alternative exhaust system generally designated 34' is illustrated in FIGS. 1, 2 and 3. Muffler assembly 34' includes a tubular coupling 130 secured at one end 132 to the outlet 32'. The tubular coupling 130 is connected at its other end 136 to the inlet of a hump back sound baffle plate 134 of a generally Z-shape in vertical section. The baffle 134 includes a coupling 135, sides 137, a rear wall 139 and a horizontal flange portion 141. The baffle is secured to the base 16 and the flange 141 contacts the undersurface of the horizontal flange 100 of cover 18. Flange 141 extends around the top of walls 206, 208 and flange 59 as in the preferred embodiment. The coupling 130 is angled upwardly and is of a diverging cross section with the cross-sectional area at the outlet end 132 being less than the cross-sectional area at the inlet end 136. The baffle 134 defines a generally, rectangular, enlarged sound chamber 138. The sound chamber 138 has a vertical cross-sectional area substantially greater than that of end 136 of coupling 130. The inner surfaces of the sound chamber are also lined or covered with a plurality of sound deadening or absorbing elements 140. The baffle element 134 directs the air downwardly and then horizontally to the subchamber areas 214, 216, and 218 defined by walls 210 and 212. The exhaust air expands and its velocity decreases as it passes from the coupling 130 into the sound chamber 138.

The skirts 120, 122 of the cover and the skirts 58, 59 of the base, as in the preferred embodiment, define a baffled or restricted atmospheric exhaust outlet with the baffle 134. The diverging connecting tube 130, the baffle 134 defining the sound chamber 138 and the baffled atmospheric exhaust outlet cause the exhaust air to expand, slow in velocity and then change direction by passing through a restricted outlet in a serpentine fashion. This flow pattern in conjunction with the sound absorbing material 138 substantially reduces the exhaust noise normally associated with the operation of the blower-motor units.

The muffler systems 34 and 34' are compact and easily mounted within the chamber 20 defined by the housing and the base. The overall structure results in an aesthetically pleasing suction head which is not bulky or cumbersome when a pair of blower-motor units are employed and which also is quiet in operation when compared to prior devices.

In the preferred construction, the base dimensioning is standardized so that it may be employed with a plurality of different size debris collection tanks 14. The debris collection tanks 14 for which the suction head is specifically designed are more fully described in copending, commonly owned application, Ser. No. 847,905, filed Nov. 2, 1977, in the name of Dale E. Lowder and entitled VACUUM CLEANER CARRIAGE AND TANK ASSEMBLY.

Figure 9:
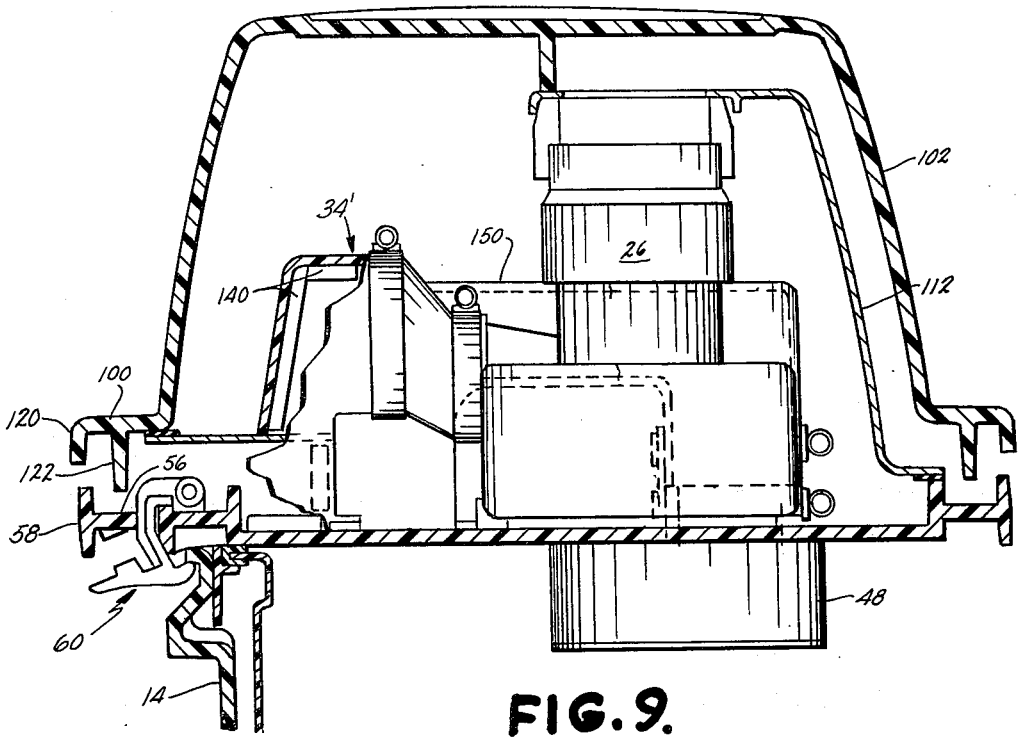
FIG. 9 is a side, elevational view in partial section of the suction head in accordance with the present invention including only one motor vac unit.
Figure 10:
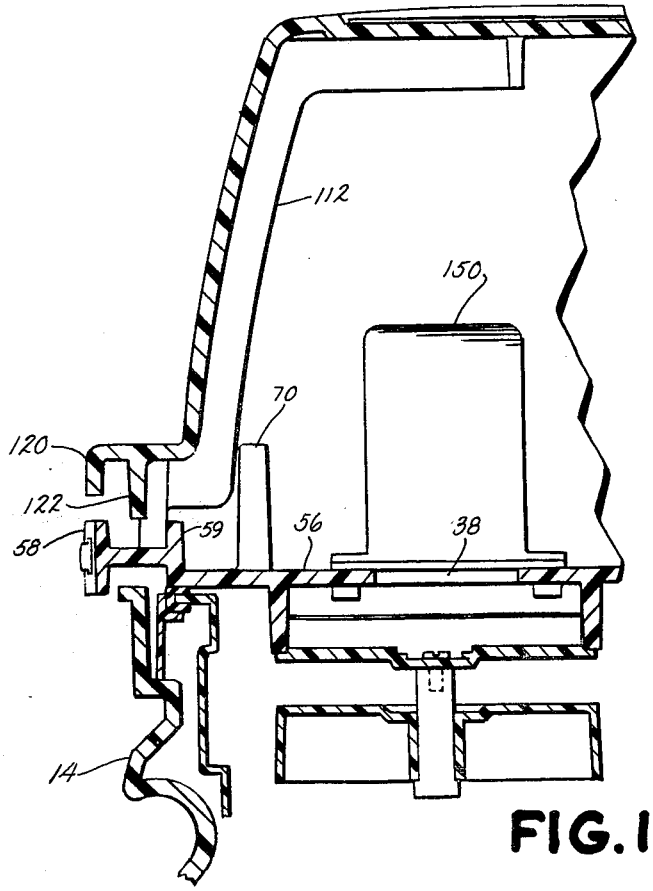
FIG. 10 is a fragmentary, elevational view in partial section of the suction head illustrated in FIG. 9.

The unique base and cover in accordance with the present invention permits a manufacturer to produce readily suction heads having either a pair of blower-motor or suction units connected in series or a single blower-motor unit depending upon the ultimate application of the apparatus. This ease of adaptation or increased versatility is clearly illustrated in FIGS. 9 and 10. In this alternative embodiment designated 10', the blower-motor unit 22 has been eliminated and replaced by a connecting tube 150. The connecting tube 150 has one end disposed over and around the intake aperture 38. A suitable gasket is disposed between the tube end and the surface of the base. The opposite end of the connecting tube 150 is coupled to transfer inlet aperture 40. As a result, suction created by the blower-motor unit 24 will draw air up from the collection tank 14 through the intake aperture 38, through the connection tube 150, and through the transfer chamber 50 defined by housing 48 and plate 52 to the intake of the blower-motor unit 24. The air from the blower-motor unit is exhausted through muffler system 34 or 34' as described above.

The various elements of the suction head are easily manufactured using conventional techniques. For example, the base 16 may be injection molded from an ABS structural foam material. It is presently preferred that the plates or baffles 112 which define the intake cooling air passages be molded from a high impact, ABS plastic material. The foam sound absorbing elements disposed within the sound deadening chamber 138 are preferably fabricated from a number 4 density acoustical polyurethane foam of 70 to 80 pores per inch. It is preferred that a pressure sensitive adhesive be applied to one side of the sound absorbing elements permitting easy attachment to the inner surfaces of the baffle 134.

It should now be readily apparent that the unique suction head in accordance with the present invention permits a manufacturer to standardize parts thereby reducing manufacturing costs while permitting the easy manufacture and efficient assembly of either a dual vacuum motor unit or a single vacuum motor unit. Noise associated with intake cooling air and the noise associated with the exhaust from the blower-motor units is substantially reduced by the unique cooling air intake passage, exhaust passage and muffler structure disclosed. When a pair of blower-motor units are employed in series, the present invention permits them to be positioned side-by-side and interconnected along the undersurface of the base structure. This feature reduces the overall dimensions of the suction head and also permits the unit to be standardized for use with a plurality of different volume debris collection tanks.

In view of the above description, those of ordinary skill in the art will undoubtedly become aware of various modifications to the unique vacuum cleaner apparatus disclosed herein which would not depart from the inventive concepts employed. Therefore, it is expressly intended that the above description should be considered as that of the preferred embodiments. The true spirit and scope of the present invention will be determined by reference to the appended claims.

The embodiments of the invention in which an exclusive property or privilege is claimed are defined as follows.

1. A vacuum cleaning apparatus suction head adapted for use with a collection tank, said suction head comprising:

a base adapted for mounting on said collection tank, said base defining an intake aperture;

a suction unit mounted on said base, said unit including a suction intake in communication with said intake aperture and an exhaust outlet;

exhaust muffler means defined in part by said base for defining a sound chamber having an inlet and an atmospheric outlet for muffling exhaust noise, said exhaust muffler means including said base having a generally flat section and a plurality of sound chamber defining walls extending vertically from said base generally flat section, said walls defining a plurality of interconnected subchambers which collectively define said sound chamber and a baffle plate resting on said sound chamber defining walls, said baffle plate having an inlet aperture defining said sound chamber inlet, one of said walls having a notch to define said atmospheric outlet;

a plurality of sound absorbing elements positioned within said sound chamber; and means for connecting said suction unit exhaust outlet with said sound chamber inlet.

2. A suction head as defined by claim 1 further including a cover mounted on said base, said cover including a peripheral, depending skirt extending towards said base for defining a baffle at said atmospheric outlet of said exhaust muffler means.

3. A suction head as defined by claim 2 wherein said base further includes an upstanding peripheral skirt extending upwardly towards and in spaced relationship with said cover skirt to further baffle said atmospheric exhaust outlet whereby the exhaust air passes through said atmospheric outlet in a serpentine fashion.

4. A vacuum cleaning apparatus suction head adapted for use with a collection tank, said suction head comprising:

a base, said base defining an intake aperture;

a suction unit mounted on said base, said unit including a suction intake in communication with said intake aperture and an exhaust outlet;

exhaust muffler means defined in part by said base for defining a sound chamber having an inlet and an atmospheric outlet for muffling exhaust noise;

a plurality of sound absorbing elements positioned within said sound chamber;

means for connecting said suction unit exhaust outlet with said sound chamber; and a cover mounted on said base, said cover including a peripheral, depending skirt extending towards said base for defining a baffle at said atmospheric outlet of said exhaust muffler means, said base further including an upstanding peripheral skirt extending upwardly towards and in spaced relationship with said cover skirt to further baffle said atmospheric exhaust outlet whereby the exhaust air passes through said atmospheric outlet in a serpentine fashion, said exhaust muffler means including said base having at least one upstanding wall extending in spaced relationship with said upstanding peripheral skirt and a baffle plate positioned on said upstanding wall and said upstanding peripheral skirt to define said sound chamber, said sound absorbing elements covering the interior of said sound chamber and said upstanding peripheral skirt having a notched area to define said atmospheric outlet, said baffle plate being generally flat and including an inlet aperture and said connecting means comprising a tube having a 90° bend connected at one end to said baffle plate inlet aperture and at the other end to said suction unit exhaust outlet.

5. A suction head as defined by claim 4 wherein said exhaust muffler means further includes at least one intermediate wall having a cutout portion dividing said sound chamber into subchambers.

6. A suction head as defined by claim 5 further including:

a cooling air intake member secured to the inner surface of said cover to define with said cover a cooling air intake passage for said suction unit, said passage having an inlet at the periphery of said cover and an outlet above said suction unit; and a gasket sealingly positioned between said cooling air intake passage outlet and said suction unit.

7. A suction head as defined by claim 6 wherein said base includes a plurality of integral mounting posts, said suction unit being secured to said mounting posts.

8. A suction head for a vacuum cleaning apparatus, comprising:

a base having an upper surface and an undersurface and defining therebetween a suction intake aperture, a transfer inlet aperture and a transfer outlet aperture;

a blower-motor unit mounted on said base and including a suction intake and an exhaust outlet, said suction intake being positioned over said transfer outlet aperture;

means on the undersurface of said base for defining therewith an air transfer chamber connecting said transfer inlet aperture with said transfer outlet aperture; and means mounted on said base for placing said transfer inlet aperture in flow communication with said suction intake aperture.

9. A suction head as defined by claim 8 further including:

an exhaust baffle mounted on said base and defining therewith an exhaust sound chamber having walls and an atmospheric outlet opening;

a plurality of sound absorbing elements carried by the walls of said sound chamber; and coupling means for coupling said blower-motor unit exhaust outlet to said exhaust sound chamber, said coupling means and said exhaust baffle configured so that the air exhausted by said blower-motor unit changes direction and the exhaust noise is muffled as it passes to said atmospheric outlet opening.

10. A suction head as defined by claim 9 wherein said means for placing said transfer inlet aperture in flow communication with said intake aperture comprises:

another blower-motor unit mounted on said base and having a suction inlet positioned over said suction intake aperture and an exhaust outlet; and means for coupling said another blower-motor unit exhaust outlet to said transfer inlet aperture.

11. A suction head as defined by claim 9 wherein said means for placing said transfer inlet aperture in flow communication with said intake aperture comprises:

a connecting tube having ends, one of said ends being connected to said suction intake aperture and the other of said ends being connected to said base at said transfer inlet aperture.

12. A suction head as defined by claim 9 further including a molded cover mounted on said base, said cover including a pair of spaced, inner and outer, downwardly extending skirts, said skirts baffling said atmospheric outlet opening.

13. A suction head as defined by claim 12 wherein said base includes a pair of spaced inner and outer upwardly extending peripheral skirts, said base skirts cooperating with said cover skirts so that said atmospheric outlet opening is baffled and serpentine in nature.

14. A suction head as defined by claim 12 further including a cooling air intake member carried by said cover and extending from the periphery thereof to a point above said blower-motor unit, said cooling air intake member defining a motor cooling air passage having an inlet baffled by said inner and outer cover skirts and an outlet over said blower-motor unit.

15. A suction head as defined by claim 8 wherein said means for placing said transfer inlet aperture in flow communication with said intake aperture comprises:

another blower-motor unit mounted on said base and having a suction inlet positioned over said suction intake aperture and an exhaust outlet; and means for coupling said another blower-motor unit exhaust outlet to said transfer inlet aperture.

16. A suction head as defined by claim 8 wherein said means for placing said transfer inlet aperture in flow communication with said intake aperture comprises:

a connecting tube having ends, one of said ends being connected to said suction intake aperture and the other of said ends being connected to said transfer inlet aperture.

17. An improved suction head for a wet/dry vacuum cleaning apparatus of the type including an open topped collection tank on which the suction head is mounted, said head including a base plate adapted to be mounted on the open topped collection tank, a cover secured to said base plate to define therewith a suction unit enclosure, a suction unit mounted on said base plate and having an inlet and an exhaust outlet, wherein the improvement comprises:

muffler means mounted within said suction unit enclosure and connected to said suction unit exhaust outlet for muffling exhaust noise and directing exhaust air to the periphery of said base plate, said muffler means including a diverging, generally upwardly angled exhaust tube having an inlet and an outlet, said inlet connected to said suction unit exhaust outlet, said base plate including an upstanding flange, a hump back sound baffle plate secured to said base plate and overlying said flange and defining a sound chamber, said baffle plate having an inlet and defining an atmospheric exhaust outlet with said base plate, said baffle plate inlet connected to said exhaust tube outlet and a plurality of sound absorbing elements positioned within said sound chamber, said baffle plate configured to direct exhaust air downwardly and then horizontally to said atmospheric exhaust outlet.

18. An improved suction head as defined by claim 17 wherein said base plate and said cover include opposed, peripheral skirts at said sound chamber atmospheric exhaust outlet to define a baffled, serpentine outlet passage.

19. A vacuum cleaner suction head comprising:

a base having an intake aperture therethrough;

a cover including a top, sides and a depending peripheral skirt, said cover being secured to said base so that the peripheral skirt thereof extends in vertically spaced relationship with the periphery of said base, said base and said cover defining a blower-motor unit enclosure, said cover further defining a cooling air intake passage extending from said peripheral skirt to said top;

a blower-motor unit having a suction intake and an exhaust outlet, said unit being positioned below the outlet of said cover cooling air passage, said base further having a transfer inlet aperture and a transfer outlet aperture therethrough, said blower-motor suction intake being positioned over said transfer outlet aperture; and transfer means carried by said base for placing said transfer inlet aperture in flow communication with said transfer outlet and with said base intake aperture.

20. A vacuum cleaner suction head as defined by claim 19 further including an exhaust muffler means within said enclosure mounted on said base and connected to said blower-motor unit exhaust outlet and defining an atmospheric outlet for directing exhaust air to the periphery of said cover and to said atmospheric outlet at said peripheral skirt and for muffling exhaust noise.

21. A vacuum cleaner suction head as defined by claim 20 wherein said base includes a peripheral upstanding skirt and wherein said exhaust muffler means includes said base having at least one upstanding wall extending in spaced relationship with said upstanding peripheral skirt and a baffle plate positioned on said peripheral wall and said upstanding peripheral skirt to define a sound chamber; and a plurality of sound absorbing elements covering the interior of said sound chamber, said upstanding peripheral skirt having a notched area to define said atmospheric outlet.

22. A vacuum cleaner suction head, comprising:

a base having an intake aperture therethrough;

a cover including a top, sides and a depending peripheral skirt, said cover being secured to said base so that the peripheral skirt thereof extends in vertically spaced relationship with the periphery of said base, said base and said cover defining a blower-motor unit enclosure, said cover further defining a cooling air intake passage extending from said peripheral skirt to said top;

a blower-motor unit having a suction intake and an exhaust outlet, said unit being positioned below the outlet of said cover cooling air passage; and transfer means carried by said base for placing said blower-motor unit suction intake in flow communication with said base plate intake aperture, said transfer means comprising:

a housing joined to the undersurface of said base and defining an air transfer chamber having a transfer inlet and a transfer outlet through said base, said blower-motor unit suction intake being above said transfer outlet.

23. A vacuum cleaner suction head as defined by claim 22 wherein said transfer means further includes a connecting tube having an end secured to said base at said intake aperture and an end secured to said transfer inlet.

24. A vacuum cleaner suction head as defined by claim 22 wherein said transfer means further includes another blower-motor unit mounted on said base at said intake aperture in side-by-side relationship with said blower-motor unit and a coupling tube connecting the exhaust outlet of said another blower-motor unit to the transfer inlet of said transfer chamber.

25. A vacuum cleaner suction head as defined by claim 24 wherein said cover defines another cooling air intake passage extending from said peripheral skirt to said top, said another cooling air intake passage having an outlet over said another blower-motor unit.

26. A vacuum cleaner suction head as defined by claim 25 wherein said base includes a plurality of integral mounting posts positioned around said intake aperture and said transfer outlet aperture, said blower-motor units being secured to said mounting posts.

27. A vacuum cleaner suction head, comprising:

a base having an intake aperture therethrough;

a cover including a top, sides and a depending peripheral skirt, said cover being secured to said base so that the peripheral skirt thereof extends in vertically spaced relationship with the periphery of said base, said base and said cover defining a blower-motor unit enclosure, said cover further defining a cooling air intake passage extending from said peripheral skirt to said top;

a blower-motor unit having a suction intake and an exhaust outlet, said unit being positioned below the outlet of said cover cooling air passage;

transfer means carried by said base for placing said blower-motor unit suction intake in flow communication with said base intake aperture; and an exhaust muffler means within said enclosure mounted on said base and connected to said blower-motor unit exhaust outlet and defining an atmospheric outlet for directing exhaust air to the periphery of said cover and to said atmospheric outlet at said peripheral skirt and for muffling exhaust noise, said exhaust muffler means comprising:

a diverging, upwardly angled exhaust tube connected at one end, to the exhaust outlet of said blower-motor unit; and a baffle secured to said base defining a sound chamber having an inlet and an outlet at the periphery of said cover skirt, said inlet being connected to said exhaust tube, said chamber being generally rectangular in shape and including an enlarged humped area at said sound chamber inlet.

28. A vacuum cleaner suction head, comprising:

a base having an intake aperture therethrough;

a cover including a top, sides and a depending peripheral skirt, said cover being secured to said base so that the peripheral skirt thereof extends in vertically spaced relationship with the periphery of said base, said base and said cover defining a blower-motor unit enclosure, said cover further defining a cooling air intake passage extending from said peripheral skirt to said top;

a blower-motor unit having a suction intake and an exhaust outlet, said unit being positioned below the outlet of said cover cooling air passage;

transfer means carried by said base for placing said blower-motor unit suction intake in flow communication with said base intake aperture; and an exhaust muffler means within said enclosure mounted on said base and connected to said blower-motor unit exhaust outlet and defining an atmospheric outlet for directing exhaust air to the periphery of said cover and to said atmospheric outlet at said peripheral skirt and for muffling exhaust noise, said base including a peripheral upstanding skirt and wherein said exhaust muffler means includes said base having at least one upstanding wall extending in spaced relationship with said upstanding peripheral skirt and a baffle plate positioned on said peripheral wall and said upstanding peripheral skirt to define a sound chamber; and a plurality of sound absorbing elements covering the interior of said sound chamber, said upstanding peripheral skirt having a notched area to define said atmospheric outlet, said baffle plate including an inlet aperture and said connecting means comprising a tube having a 90° bend connected at one end to said baffle plate inlet aperture and at the other end to said suction unit exhaust outlet.

29. A suction head as defined by claim 28 wherein said exhaust muffler means further includes at least one intermediate wall having a cutout portion dividing said sound chamber into subchambers.

* * * * *